United States Patent [19]

Miller

[11] 4,034,923

[45] July 12, 1977

[54] WINDER FOR YARN AND THE LIKE

[75] Inventor: Harry B. Miller, Hopedale, Mass.

[73] Assignee: Industriewerke Karlsruhe-Augsburg Aktiengesellschaft, Karlsruhe, Germany

[21] Appl. No.: 556,556

[22] Filed: Mar. 7, 1975

Related U.S. Application Data

[63] Continuation-in-part of Ser. No. 354,920, April 26, 1973, Pat. No. 3,876,161.

[51] Int. Cl.[2] ..... B65H 54/02; B65H 67/04

[52] U.S. Cl. ..... 242/18 A; 242/18 PW

[58] Field of Search ..... 242/18 A, 18 PW, 18 DD, 242/35.5 R, 25 A

[56] References Cited

U.S. PATENT DOCUMENTS 3,876,161 4/1975 Miller ..... 242/18 A

*Primary Examiner*—Stanley N. Gilreath

*Attorney, Agent, or Firm*—Michael J. Striker

[57] ABSTRACT

A drive roll has an axis of rotation and at least two rotatable chucks are provided, each being adapted to have a yarn package formed thereon. The chucks each have an axial end and are movable into and out of driven engagement with the drive roll. A traversing arrangement traverses a running yarn which is being wound onto one of the chucks, in order to form a yarn package thereon. A yarn transfer arrangement effects automatic transfer of the running yarn from the one chuck upon forming of the yarn package thereon to the empty other chuck while the latter is in driven engagement with the drive roll. This arrangement includes an arm which is mounted on the drive roll to be turnable about the axis of rotation of the latter and which has a free end portion arranged to travel in a path adjacent the axial end of the other chuck and intersecting the axis of rotation of the other chuck while the same is in engagement with the drive roll.

9 Claims, 10 Drawing Figures

FIG. 5
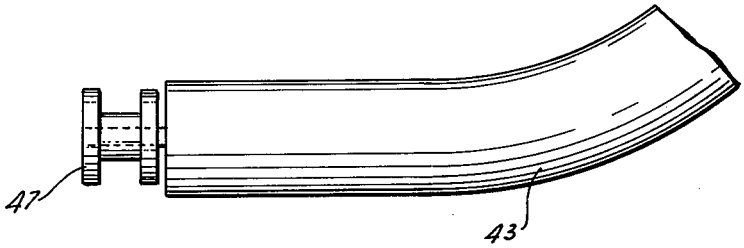
FIG. 9
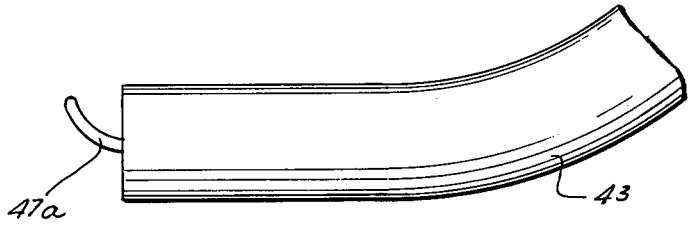
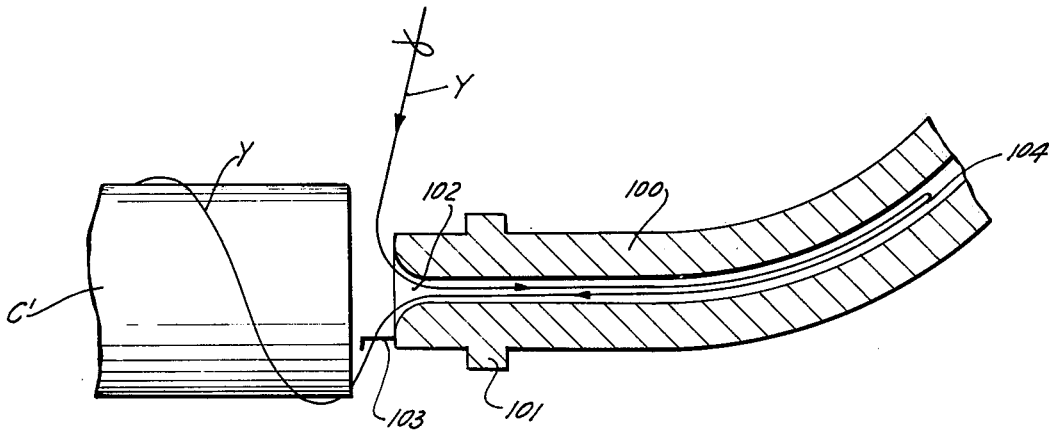
FIG. 10

WINDER FOR YARN AND THE LIKE

CROSS-REFERENCE TO RELATED APPLICATION

The present application is a continuation-in-part of my copending prior application Ser. No. 354,920, filed on Apr. 26, 1973 and now U.S. Pat. No. 3,876,161.

BACKGROUND OF THE INVENTION

This invention relates generally to a winder for yarn and the like, and in particular to a transfer arrangement for effecting automatic transfers of yarn between the chucks of such a winder.

One of the basic machines used by all yarn producers, usually in batteries of dozens or more machines, is the so-called yarn winder. These machines are needed to wind yarn onto a bobbin tube which is mounted on a rotatable chuck, to form a yarn package on this bobbin tube. The yarn, which term as employed in the present application is intended to include threads, filaments and the like, is usually directly supplied from a producing device to the yarn winding apparatus. Such apparatuses have rotatable chucks which can be moved into and out of surface-driven engagement with a rotatable drive roll. When a yarn package on one of the chucks has reached full size, the incoming "running" yarn must be cut, the bobbin tube with the package removed from the chuck, a new bobbin tube put in place on the chuck, and the winder must be rethreaded with the running yarn so that the yarn can begin to form a new package on the new bobbin tube.

Since textile mills using these winders usually operate continuously, that is 24 hours per day, the necessity that an individual operator be present at the respective winder when a yarn package is completed, to cut the yarn, remove the package, place a new bobbin tube onto the chuck and string up the winder again, has long been considered onerous because of the high labor costs involved.

In my aforementioned copending application, Ser. No. 354,920, I have disclosed a winder which has three chucks and is provided with an automatic yarn transfer system that transfers the incoming "running" yarn from a chuck on which a yarn package has been completed, to another chuck which carries an empty bobbin tube and is therefore ready to start winding the yarn in order to form a new package. My deliberations have meanwhile shown that it is possible to further improve certain features of this apparatus.

SUMMARY OF THE INVENTION

It is, accordingly, a general object of this invention to provide a winder for yarn and the like which incorporates these improved features.

More particularly, it is an object of the present invention to provide a winder of the type in question which has an improved yarn transfer system.

An additional object of the invention is to provide such a winder which incorporates improved yarn severing means.

Still a further object of the invention is to provide such a winder which provides these improvements but is nevertheless simple in its construction and reliable in its operation.

In keeping with these objects, and with others which will become apparent hereafter, one feature of the invention resides in a winder for yarn and the like which, briefly stated, comprises a drive roll having an axis of rotation, and at least two rotatable chucks each adapted to have a yarn package formed thereon, these chucks each having an axial end and being movable into and out of driven engagement with the drive roll. A traversing arrangement is provided for traversing a running yarn which is being wound onto one of the chucks, so as to form a yarn package thereon. Yarn transfer means is also provided for effecting automatic transfer of the running yarn from the one chuck upon forming of the yarn package thereon to the empty other chuck while the same is in driven engagement with the drive roll. The yarn transfer means includes an arm on the drive roll turnable about the axis of rotation of the latter and having a free end portion arranged to travel in a path adjacent to the axial end of the other chuck and intersecting the axis of rotation of the latter.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 5 is a fragmentary side view, illustrating a detail of FIG. 4;

FIG. 9 is a fragmentary side view showing a detail of a modified embodiment; and FIG. 10 is a fragmentary partly sectioned view, showing a detail of still another embodiment of the invention.

DESCRIPTION OF THE PREFERRED EMBODIMENTS

The basic winding apparatus, of which the present invention constitutes improvements, is disclosed in my aforementioned copending application Ser. No. 354,920, the entire disclosure of which is herewith incorporated by reference.

Figure 1:
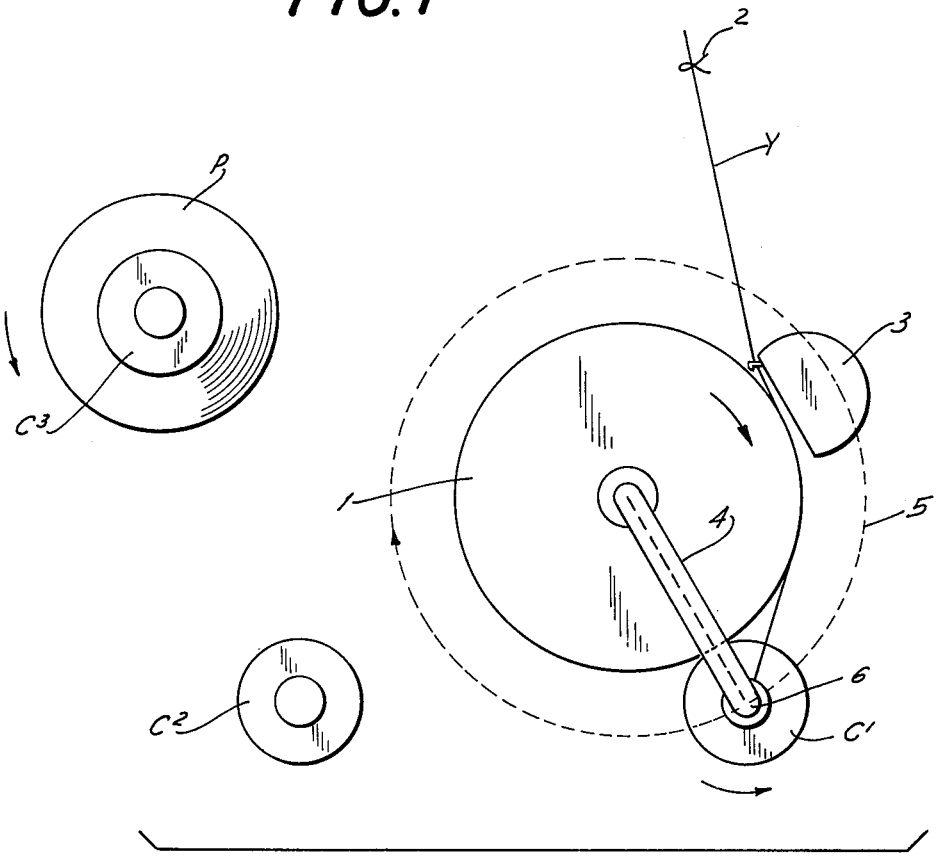
FIG. 1 is a diagrammatic end view showing details of one embodiment of the invention.
Figure 2:
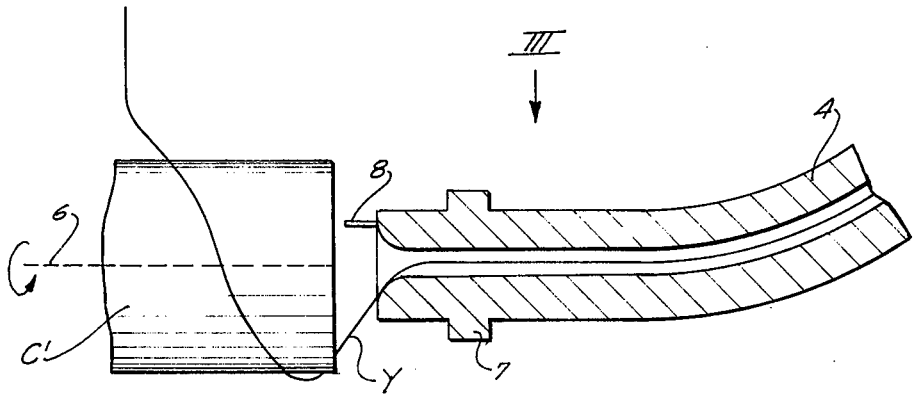
FIG. 2 is a fragmentary view, partly in section and on an enlarged scale, showing details of FIG. 1.
Figure 3:
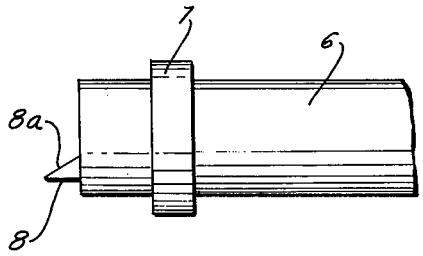
FIG. 3 is a fragmentary top-plan view of FIG. 2 as seen in the direction of the arrow III.

FIGS. 1–3 show a first embodiment of the present invention, only those portions of the winding apparatus being shown which are necessary for an explanation of the invention. The other details correspond to those disclosed in the aforementioned copending application.

Reference numeral 1 in FIGS. 1–3 identifies a drive roll which is driven in suitable manner in the direction indicated by the arrow. A plurality of chucks is provided, in the illustrated embodiment chucks C1, C2 and C3; these chucks can be moved transversely into and out of driving engagement with the drive roll 1, in the manner disclosed in the copending application. Each of the chucks C1–C3 is adapted to carry a bobbin tube (not shown) onto which a package P of yarn Y is to be wound. Chuck C3 has such a package P wound on it and has been retracted from contact with the circumferential surface of the drive roll 1 so that the package P can be removed from the chuck. Chuck C1, on the other hand, is in engagement with the drive roll and is rotated by the same in the direction indicated by the associated arrow, in order to have a yarn package formed on its bobbin tube. Reference numeral 3 identifies a traverse arrangement which is known from the art and is also disclosed in my aforementioned copending application; this traverse arrangement receives the running yarn Y from a diagrammatically illustrated yarn guide 2 and traverses it axially of the drive roll 1 and thus of the respective chuck, in this instance the chuck C1.

The embodiment in FIGS. 1–3 is provided with an automatic yarn transfer arrangement which transfers the running yarn from that chuck on which a package has been completed (i.e. in FIG. 1 the chuck C3) to another chuck onto which a package is to be wound, as the chuck C1 in FIG. 1. This arrangement has a yarn aspirator 4 which is mounted on the drive roll 1 and rotates about the axis of rotation of the latter; such an aspirator tube, which is curved, is disclosed in my aforementioned application. However, in the illustrated embodiment the free end of the aspirator tube 4, which is provided with an inlet communicating with the interior passage of the tube 4 which in turn is connected to a source of suction (not shown), is so located that it travels in a path 5 which passes through the axis of rotation of the respective chuck which is empty and has just been moved into driven engagement with the drive roll 1, that is in FIG. 1 the chuck C1. Details of how and at what times the aspirating tube 4 is rotated in the path 5, may be ascertained from my aforementioned copending application.

As FIGS. 2 and 3 show, the free end face at the free end of the aspirator tube 4 is provided with a cutting blade 8 whose contour is shown in FIG. 3. It will be noted that reference numeral **8*a* in FIG. 3 identifies an inclined cutting edge of the blade 8. Reference numeral 7 identifies a flange on the aspirating tube 4** which prevents the yarn from slipping in an undesired direction.

In this embodiment the yarn will be transferred between the chucks in the manner disclosed in my aforementioned copending application. Once the running yarn has begun to wind onto the rotating empty chuck, that is the chuck C1 in the illustration of FIGS. 1–3, it will be moved by this rotation into engagement with the cutting edge **8*a* of the blade 8; during this time some of the yarn is located in the interior passage of the aspirating tube 4, being drawn lengthwise of the passage by the suction applied to the latter, for the reasons and in the manner disclosed in the aforementioned copending application. This means that with each revolution performed by the chuck C1 the portion of the yarn Y between the inlet to the passage of the aspirator tube 4 and the chuck C1 will move into contact with the cutting edge 8*a* of the blade 8; if it is not severed upon the first such contact, the yarn portion in question will keep moving into engagement with the cutting edge 8*a* until it is finally severed, so that the portion of the yarn which is located in the passage of the aspirating tube 4 will be pulled away by the suction acting in the passage. At this time the aspirating tube 4, which has remained stationary opposite the axial end of the chuck C1 from the time at which it brought around the yarn from the chuck C3 until the time at which the cutting has occurred, is ready to move on its path 5** to perform further yarn transfer operations, as fully disclosed in my copending application.

FIGS. 4–8 show a further embodiment of the invention. In these Figures the chucks C1, C2 and C3 are again shown in relation to the drive roll which is here identified with reference numeral 40. The chuck C3 again carries a yarn package P. The traverse guide is identified with reference numeral 42, and the direction of rotation of the rotatable components are all indicated by respective arrows.

In this instance, however, the transfer arrangement does not use an aspirating tube; instead, it utilizes a curved arm 43 which is mounted for rotation on the drive roll 40 in the same manner as described with respect to the aspirating tube in the embodiment of FIGS. 1–3. The free end of the arm 43 carries, as shown in FIG. 5, a roller 47 whose purpose it is to engage the yarn Y which is supplied from a non-illustrated source via a diagrammatically shown yarn guide 41.

Figure 4:
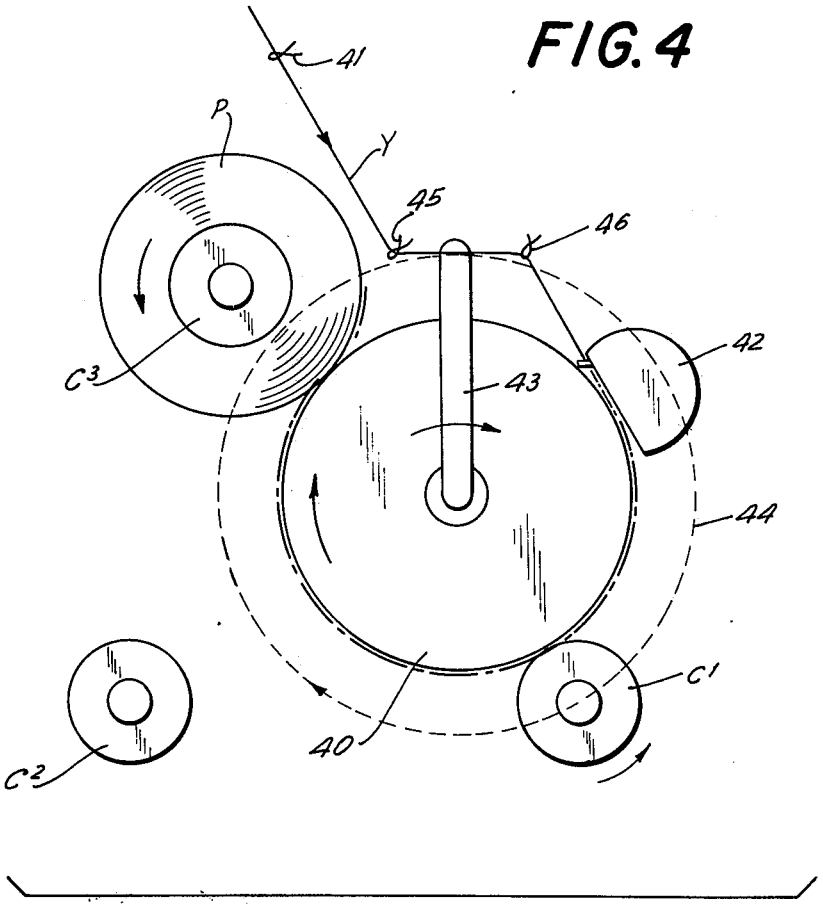
FIG. 4 is a view similar to FIG. 1 but illustrating a further embodiment of the invention.
Figure 6:
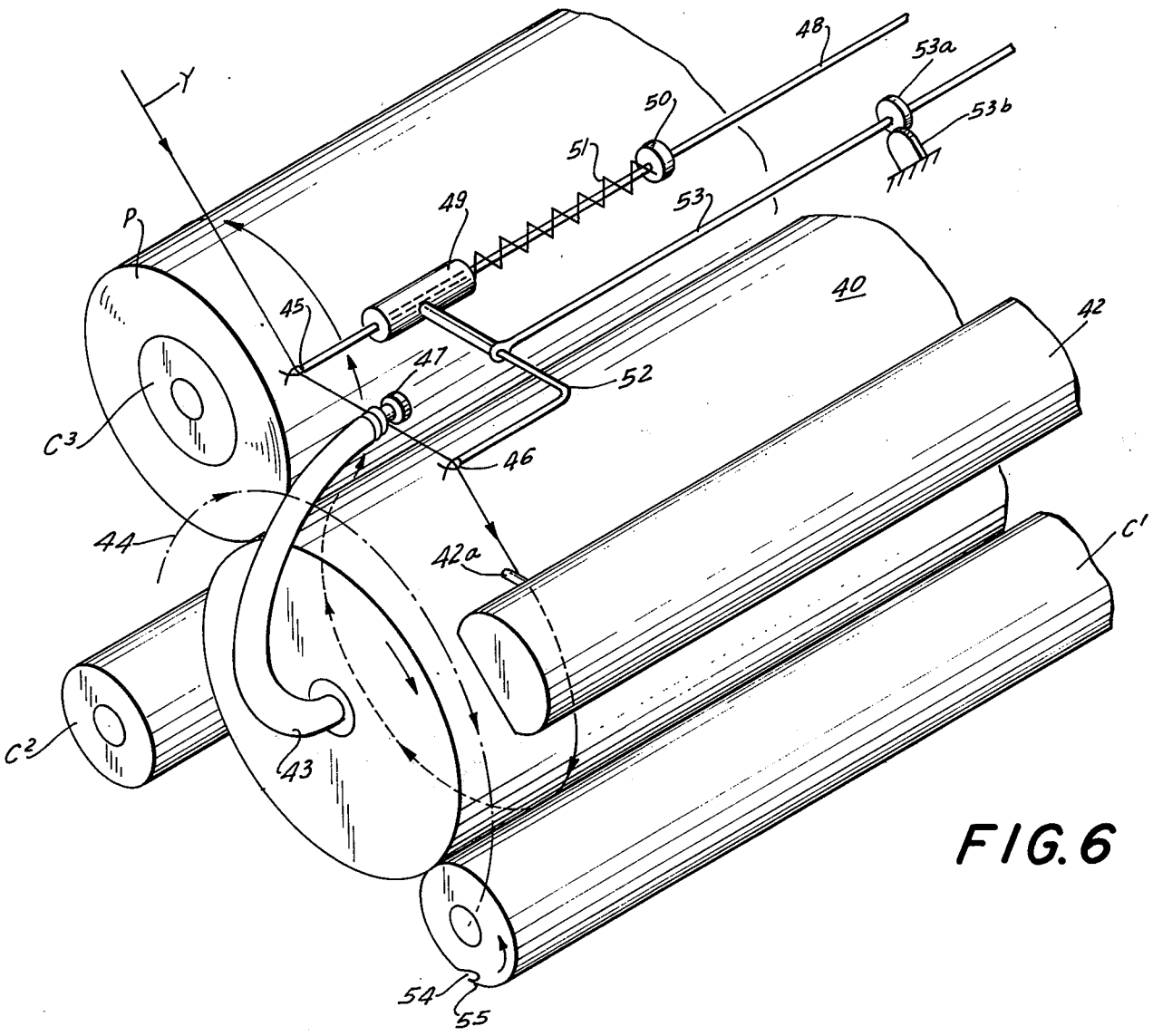
FIG. 6 is a fragmentary perspective view, showing the apparatus of FIG. 4 in one operating position of the yarn transfer arrangement.
Figure 7:
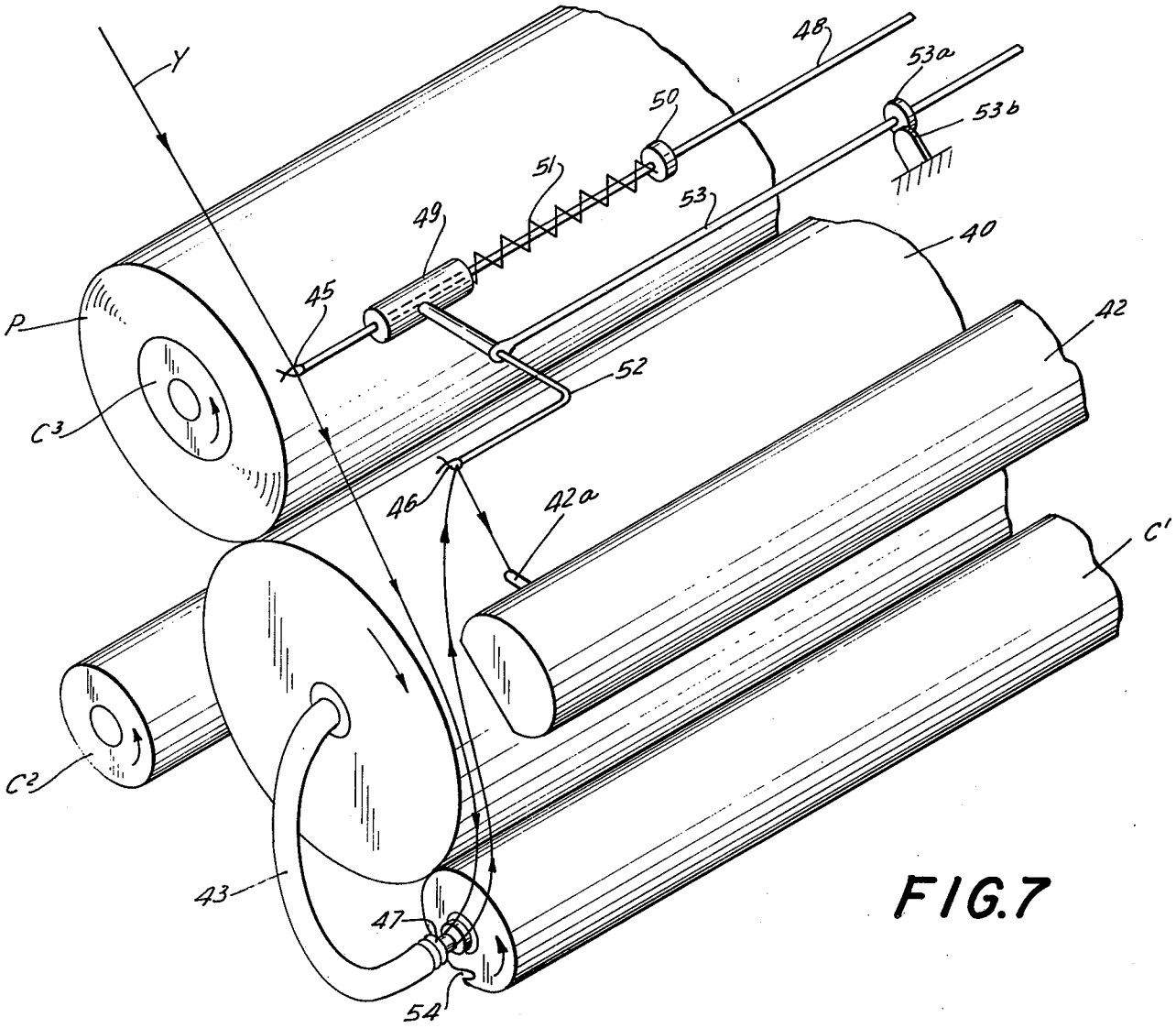
FIG. 7 is a view similar to FIG. 6 but showing the apparatus in a second operating position of the yarn transfer arrangement.
Figure 8:
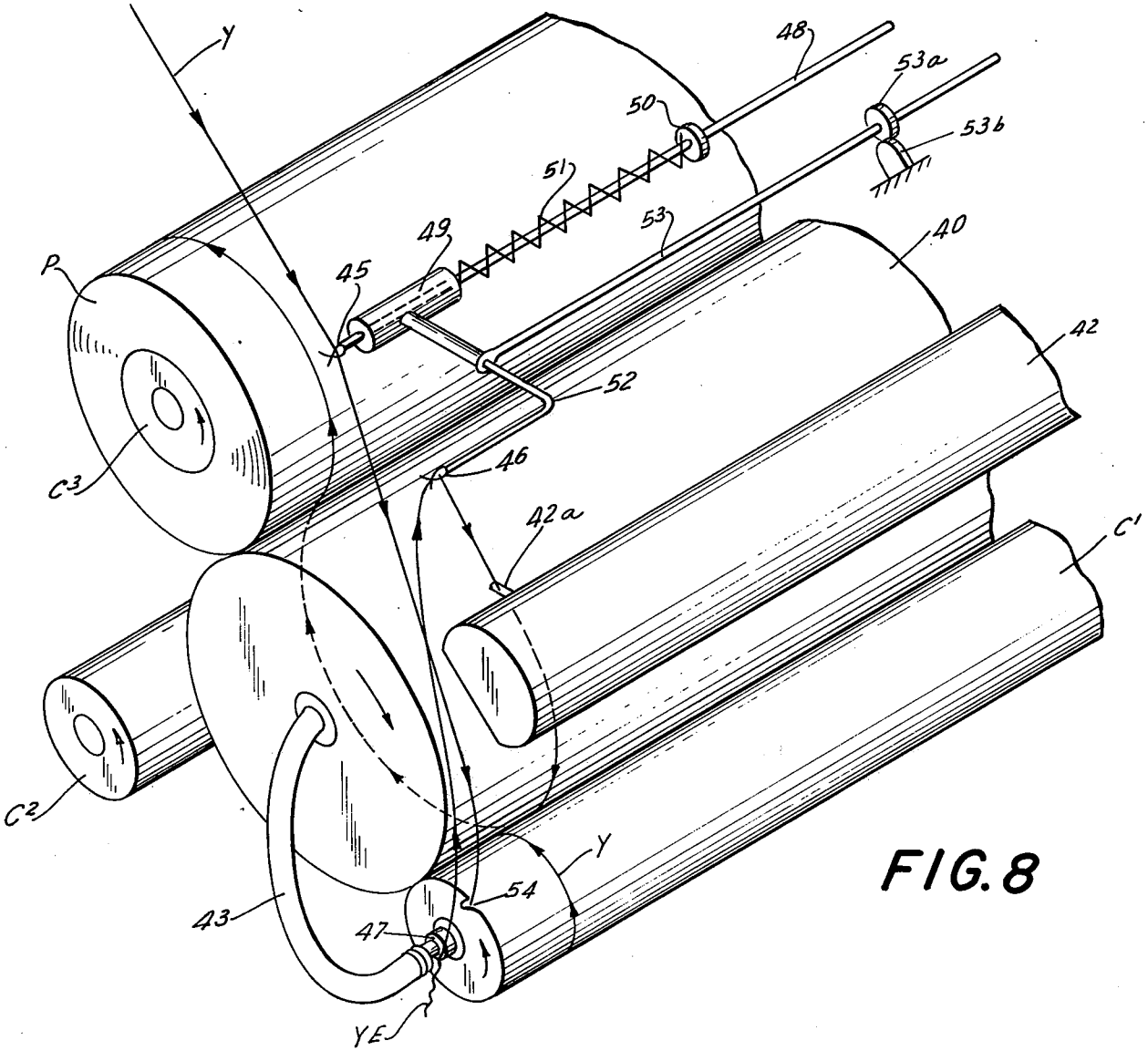
FIG. 8 is a view similar to FIG. 7, showing the apparatus in a third operating position of the yarn transfer arrangement.

FIGS. 6–8 are respective perspective views showing the embodiment of FIGS. 4 and 5 and illustrating three different operating positions of the yarn transfer arrangement.

It will be seen that a yarn shifting system is provided, utilizing yarn pushers analogous to those which are disclosed in my aforementioned copending application. The purpose of these yarn pushers is the same as in that application, namely to shift certain portions of the running yarn axially forwardly or axially rearwardly with respect to the chucks and the drive roll, in order to control their pick-up by the chuck on which a new package is to be begun, i.e. the chuck C1 in FIGS. 4–8.

The yarn pushers have two rods 48 and 53 which can both shift longitudinally of themselves, that is axially of the drive roll 40 above which they are located. The rods 48 and 53 will of course be mounted in a suitable manner so that they will extend in substantial parallelism with one another and will be able to perform such shifting movements. The rod 48 will be shifted forwardly and moved rearwardly by appropriate means (not shown) of the type disclosed in my aforementioned copending application. The rod 53 is freely movable, i.e. it is simply mounted for sliding movement. Its forward position (the position closest to the arm 43) is determined by the engagement of a stop **53*a* on the rod 53 with a stationarily mounted stop 53*b* that is mounted in suitable manner on the machine frame or the like. The rod 53 carries a transversely extending arm 52 which in turn carries a hollow sleeve 49 through which the rod 48 freely extends. The rod 48 carries an abutment 50 and is surrounded intermediate the abutment 50 and the sleeve 49 by a helical expansion spring 51 which bears upon the sleeve 49 and the abutment 50, thus urging the sleeve 49 and therefore the rod 53 to the forward position of the latter, in which the stops 53*a* and 53*b*** are in engagement with one another.

The front ends of the rods 48 and 53, that is the ends which are closest to the arm 43, each carry a yarn guide 45 and 46, respectively; these yarn guides may be of any conventional construction and are transversely spaced from one another. The running yarn which comes from a not-illustrated source of supply and is identified with reference character Y, travels first through the yarn guide 45 and thereupon through the yarn guide 46 from which it travels to the traverse guide 42 whose yarn guide 42*a* engages it as it runs onto the drive roll 40.

In the illustrated embodiment the yarn travels from the yarn guide 42*a* of the traverse guide 42 around the circumference of the drive roll 40 and winds onto the package P that is being formed on the chuck C3.

The arm 43 is rotated by an arrangement which may be of the type disclosed in my aforementioned copending application; during its rotational movement its free end portion with the roller 47 thereon travels in the path 44 which leads downwardly in clockwise direction between the yarn guides 45 and 46. For this reason the roller 47 will engage the portion of the yarn Y which is located between the yarn guides 45 and 46 and will take it along during further travel of the arm 43 to form a loop as illustrated in FIG. 7. The arm 43 continues to turn until the roller 47 is located opposite the axial end of the chuck C1 and the arm 43 then temporarily stops its rotational movement. The yarn continues to run, travelling from the yarn guide 45 around the roller 47 to the yarn guide 46, from there to the yarn guide 42*a* of the traverse guide 42, and from the yarn guide 42*a* around the roll 42 onto the package P of the chuck C3. At this time the chuck C1 already rotates at its operational speed, being in driven engagement with the circumferential surface of the drive roll 40. As soon as the roll 47 stops opposite the axial end of the chuck C1, the rod 48*i* retracted, i.e. moved towards the right in FIG. 8, relaxing the spring 51 and moving that portion of the yarn Y which extends from the yarn guide 45 to the roller 47 to a position in which it is angled slightly rearwardly in axial direction of the drive roll 40 and the chuck C1. Because of this the yarn portion in question now comes in engagement with the edge bounding the axial end of the chuck C1. This edge is formed with a hook-shaped recess 54 which is bounded by an internal edge that is sharpened to constitute a cutting edge. As soon as the yarn portion in question has moved to the position in FIG. 8 in which it rubs on the edge of the axial end of the chuck C1, the next rotation of the chuck C1 will cause the hook-shaped recess 54 to engage this yarn portion and during continuous rotation of the chuck C1 the yarn portion will move into engagement with the sharpened cutting edge of the hook-shaped recess 54 and will become cut off. At this time the running yarn Y begins to wind onto the chuck C1, as shown in FIG. 8. The cut-off yarn end YE, on the other hand, continues to be taken up onto the package P, preparatory to the movement of the chuck C3 with the package P out of engagement with the drive roll 40. A new package is at this time already being wound on the chuck C1. The arm 43 can then continue to turn in the path 44 to perform the next transfer function. The sequence of the transfers, i.e. from which package-carrying chuck the yarn is to be transferred to which empty chuck, corresponds to what has been disclosed in my aforementioned copending application.

The embodiment in FIG. 9 is identical with that in FIGS. 4–8, except that it illustrates that the free end portion of the arm 43 may be provided with a finger 47*a* instead of the roll 47. In all other respects the embodiment of FIG. 9 corresponds to that of FIGS. 4–8, and the function of the finger 47*a* is, of course, the same as that of the roll 47.

The embodiment of FIG. 10, finally, also can be used in the organization shown in FIGS. 4–8. It differs from that embodiment in that the arm 43 is replaced by an aspirator tube 100 having the same curved configuration as the arm 43 and being mounted in the same manner on the drive roll (not shown). The interior passage 102 of the aspirator tube 100 will, of course, be connected in the usual manner with a source of suction (not shown). Adjacent its free end, where the inlet to the passage 102 is provided, the aspirator tube 100 has a flange 101 which prevents slippage of the yarn Y which again is supplied via the yarn guides 45 and 46 of the arrangement described in FIGS. 4–8. Also provided on the free end face of the tube 100 is a yarn pick-up finger 103.

The embodiment in FIG. 10 forms the same loop of yarn Y as does the embodiment in FIGS. 4–8 (compare FIG. 7 for the loop), except that in FIG. 10 the yarn Y is picked up intermediate the yarn guides 45 and 46 by finger 103 and a portion of the loop is aspirated into the passage 104 where it forms a yarn storage loop as shown in FIG. 10. Because of this the aspirator tube 100 in the embodiment of FIG. 10 need have its rotational speed synchronized with the advancement speed of the running yarn Y, but can travel slightly slower than the yarn speed so that the "yarn slack" resulting from the speed differential can be drawn into the passage 102 to form the storage loop in the same. The aspirator need not engage the yarn and wait until it has formed the interior storage loop; instead, it merely engages the yarn with the finger 103 and continues turning, albeit at a slower speed than the advancement speed of the yarn Y, forming the storage loop 104 during the continued turning.

In the embodiment of FIG. 10 the chuck may be provided with a cutter for the yarn of the type illustrated at 54 in FIG. 6, or it may be provided with an analogous yarn cutter of the type disclosed in my aforementioned copending application.

Of course, in this as in all preceding embodiments, the chucks C1, C2 and C2 will all be identically equipped, so that they will have yarn cutters except, of course, in the embodiment of FIGS. 1–3 where the cutter is provided on the aspirator 4.

The arm 43 in the embodiments of FIGS. 4–9 is advantageously of light weight and may be spring loaded (e.g. with a biasing force of about 120 grams) so that it can yield in direction opposite to its path of rotational movement in the event that there should be too much yarn stress acting upon the arm; this is important because yarn stress must be avoided. It is well known that stretching of certain yarns or filaments can disadvantageously influence the ability of the yarn or filament to take dyes or similar treating fluids, thus leading to yarn waste.

A particular advantage of the invention disclosed in FIGS. 1–10 is the fact that in no case will there be any waste of yarn at all, contrary to the prior art and even to my aforementioned copending application wherein that amount of yarn that travels through the aspirator tube and is expelled from the outlet end of the latter, is ultimately wasted.

In all embodiments I prefer to provide a low-friction finish (e.g. a polytetrafluoethylene finish) on the circumferential surface of the drive roll 1 or 40, at least at the front end thereof which is closest to the arm 43 or the tube 100, since in this region the yarn Y will at times run over the surface of the roll 40 in mutually opposite directions (compare the direction of travel of the yarn portions forming the loop in FIG. 7). This reduces friction upon the yarn and avoids wear on the drive roll 40 and on the yarn.

It will be understood that each of the elements described above, or two or more together, may also find a useful application in other types of constructions differing from the types described above.

While the invention has been illustrated and described as embodied in a winder for yarn or the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a winder for yarn and the like, a combination comprising a drive roll having an axis of rotation; at least two rotatable chucks each adapted to have a yarn package formed thereon, said chucks each having an axial and being movable into and out of driven engagement with said drive roll; a traversing arrangement for traversing a running yarn which is being wound onto one of said chucks, so as to form a yarn package on the latter; yarn transfer means for effecting automatic transfer of said running yarn from said one chuck upon forming of the yarn package thereon to the empty other chuck while the same is in driven engagement with said drive roll, including an arm on said drive roll turnable about said axis of rotation thereof and having a free end portion arranged to travel in a path adjacent the axial end of said other chuck and intersecting the axis of rotation of the latter; and severing means on said free end portion of said arm for severing the running yarn from said arm when the yarn has begun to wind onto said other chuck.

2. A combination as defined in claim 1, wherein said severing means comprises a cutting blade projecting from an end face of said free end portion towards said axial end of said other chuck.

3. A combination as defined in claim 2, wherein said cutting blade is located in a plane substantially paralleling the axis of rotation of said other chuck and includes a cutting edge which is inclined to said axis of rotation of said other chuck.

4. In a winder for yarn and the like, a combination comprising a drive roll having an axis of rotation; at least two rotatable chucks each adapted to have a yarn package formed thereon, said chucks each having an axial end and being movable into and out of driven engagement with said drive roll; a traversing arrangement for traversing a running yarn which is being wound onto one of said chucks, so as to form a yarn package on the latter; yarn transfer means for effecting automatic transfer of said running yarn from said one chuck upon forming of the yarn package thereon to the empty other chuck while the same is in driven engagement with said drive roll, including an arm on said drive roll turnable about said axis of rotation thereof and having a free end portion arranged to travel in a path adjacent the axial end of said other chuck and intersecting the axis of rotation of the latter, said free end portion of said arm having an end face; and a yarn engaging roller mounted on said arm at said end face.

5. In a winder for yarn and the like, a combination comprising a drive roll having an axis of rotation, at least two rotatable chucks each adapted to have a yarn package formed thereon, said chucks each having an axial end and being movable into and out of driven engagement with said drive roll; a traversing arrangement for traversing a running yarn which is being wound onto one of said chucks, so as to form a yarn package on the latter; yarn transfer means for effecting automatic transfer of said running yarn from said one chuck upon forming of the yarn package thereon to the empty other chuck while the same is in driven engagement with said drive roll, including an arm on said drive roll turnable about said axis of rotation thereof and having a free end portion arranged to travel in a path adjacent the axial end of said other chuck and intersecting the axis of rotation of the latter, said free end portion of said arm having an end face; and a yarn engaging finger mounted on said arm at said end face.

6. In a winder for yarn and the like, a combination comprising a drive roll having an axis of rotation; at least two rotatable chucks each adapted to have a yarn package formed thereon, said chucks each having an axial end and being movable into and out of driven engagement with said drive roll; a traversing arrangement for traversing a running yarn which is being wound onto one of said chucks, so as to form a yarn package on the latter; yarn transfer means for effecting automatic transfer of said running yarn from said one chuck upon forming of the yarn package thereon to the empty other chuck while the same is in driven engagement with said drive roll, including an arm on said drive roll turnable about said axis of rotation thereof and having a free end portion arranged to travel in a path adjacent the axial end of said other chuck and intersecting the axis of rotation of the latter, said free end portion of said arm having an end face; a yarn engaging member mounted on said arm at said end face; and shifting means for shifting the running yarn axially of said drive roll and chucks toward and away from said end face; said shifting means comprising two substantially parallel longitudinally displaceable rods located above and extending axially of said drive roll, each of said rods having an end provided with a yarn guide in which the running yarn is engaged and which are so positioned that a section of the running yarn intermediate said yarn guides intersects said path, a transverse portion on one of said rods and carrying a sleeve through which the other rod freely slidably extends, an abutment on said other rod rearwardly spaced from the yarn guide of said other rod and from said sleeve, and an expansion spring bearing upon said sleeve and said abutment.

7. A combination as defined in claim 6; further comprising a stationary stop; and wherein said one rod is freely slidable and includes a stop portion which abuts said stationary stop when said one rod slides axially of said drive roll to a position in which its yarn guide is spaced from said end face by a predetermined distance.

8. A combination as defined in claim 6, wherein said arm has an internal passage provided with an inlet in said end face and adapted to be connected to a source of suction so as to aspirate a loop of the running yarn into said passage when said inlet moves past said section of running yarn intermediate said section of the same.

9. In a winder for yarn and the like, a combination comprising a drive roll having an axis of rotation; at least two rotatable chucks each adapted to have a yarn package formed thereon, said chucks each having an axial end and being movable into and out of driven engagement with said drive roll; a traversing arrangement for traversing a running yarn which is being wound onto one of said chucks, so as to form a yarn package on the latter; yarn transfer means for effecting automatic transfer of said running yarn from said one chuck upon forming of the yarn package thereon to the empty other chuck while the same is in driven engagement with said drive roll, including an arm on said drive roll turnable about said axis of rotation thereof and having a free end portion arranged to travel in a path adjacent the axial end of said other chuck and intersecting the axis of rotation of the latter, said free end portion having an end face, and said arm having an internal passage adapted to be connected to a source of suction and having an inlet in said end face; and a yarn engaging finger mounted on said arm at said end face.

* * * * *